US005476400A

United States Patent [19]

Theophanides

[11] Patent Number: 5,476,400

[45] Date of Patent: Dec. 19, 1995

[54] HYDRAULIC POWER SYSTEM FOR A BOAT

[76] Inventor: Andy E. Theophanides, 4937 Ryandale Rd., Winston-Salem, N.C. 27104

[21] Appl. No.: 322,176

[22] Filed: Oct. 12, 1994

[51] Int. Cl.[6] ..... B63H 21/12

[52] U.S. Cl. ..... 440/5

[58] Field of Search ..... 60/433; 180/242, 180/305–308; 440/5, 75, 900, 53, 61, 84–87

[56] References Cited

U.S. PATENT DOCUMENTS

| | | | |
|---|---|---|---|
| 2,953,335 | 9/1960 | Kiekhaefer | 440/61 |
| 3,369,360 | 2/1968 | De Biasi | 60/433 |
| 3,587,511 | 6/1971 | Buddrus | 440/5 |
| 3,596,626 | 8/1971 | Buddrus | 440/5 |
| 3,847,107 | 11/1974 | Buddrus | 440/5 |
| 3,915,111 | 10/1975 | Buddrus | 440/5 |
| 4,143,614 | 3/1979 | Jeanson et al. | 115/41 HT |
| 4,358,280 | 9/1982 | Jeanson et al. | 440/61 |
| 4,878,864 | 11/1989 | Van Bentem | 440/5 |
| 5,022,987 | 6/1991 | Wells | 440/5 |
| 5,335,750 | 8/1994 | Geringer et al. | 180/307 |

*Primary Examiner*—Edwin L. Swinehart
*Attorney, Agent, or Firm*—Michael I. Kroll

[57] ABSTRACT

An hydraulic power system for a boat comprising a marine thruster assembly. A structure is for mounting the marine thruster assembly to an exterior surface of a transom on the boat. A first hydraulic operative facility is for propelling the marine thruster assembly, so that the boat can travel in a body of water. A second hydraulic operative facility is for steering the marine thruster assembly, so that the boat can be directed on a course in the body of water. A third hydraulic operative facility is for lifting the marine thruster assembly out of the body of water for inspection and repair when needed.

7 Claims, 3 Drawing Sheets

HYDRAULIC POWER SYSTEM FOR A BOAT

BACKGROUND OF THE INVENTION

1. Field of the Invention

The instant invention relates generally to propulsion units for marine vessels and more specifically it relates to an hydraulic power system for a boat.

2. Description of the Prior Art

Numerous propulsion units for marine vessels have been provided in prior art. For example, U.S. Pat. Nos. 4,143,614 to Jeanson et al.; 4,358,280 to Jeanson et al. and 4,878,864 to Van Bentem all are illustrative of such prior art. While these units may be suitable for the particular purpose to which they address, they would not be as suitable for the purposes of the present invention as heretofore described.

The screw of a screw-rudder propulsion assembly for a floating vehicle is suspended on the end of a steering shaft which is housed in a tubular casing which is supported on the vehicle. The shaft is rotated to steer the vehicle and the screw is driven by a hydrostatic receiver unit housed in the screw-rudder assembly. A pair of rotating joints through which oil is circulated to the hydrostatic receiver unit, a trust bearing, and the steering drive for rotating the steering shaft are grouped together at the top of the shaft.

A screw-rudder assembly is mounted at the bottom of a steering shaft which rotates in a tubular casing which is mounted on slide shoes which slide in vertical slide guides fixed to a support which is mounted on a floating vehicle. A power cylinder connects the tubular casing to the support and slides the casing upwardly to regulate the depth of immersion of the screw and pivots the casing upwardly about upper slide shoes when bottom slide shoes are released through passages in the slide guides, to lift the screw-rudder out of the water.

A new and improved compass-type retractable marine thruster apparatus comprises a housing pivotally mounted on a base that can be attached to the stern of a vessel. A tubular member has an upper section extending into the housing. A hub is attached to the lower end of the tubular member. A cross-vane hydraulic motor is in the hub and has a propeller mounted directly on its output shaft. A swivel assembly at the top of the tubular member is arranged so that oil under pressure can be fed to a plurality of lines that are connected to the motor. A steering motor is for rotating the tubular member about its longitudinal axis. An hydraulic cylinder can be extended to pivot the tubular member, hub and propeller out of the water.

SUMMARY OF THE INVENTION

A primary object of the present invention is to provide an hydraulic power system for a boat that will overcome the shortcomings of the prior art devices.

Another object is to provide an hydraulic power system for a boat, in which an hydraulic circuit is connected to and operated by an engine to drive a marine thruster assembly, so as to propel and steer the boat within a body of water.

An additional object is to provide an hydraulic power system for a boat, in which the hydraulic power system can also operate a pair of hydraulic cylinders to lift the marine thruster assembly out of the body of water for inspection and repair when needed.

A further object is to provide an hydraulic power system for a boat that is simple and easy to use.

A still further object is to provide an hydraulic power system for a boat that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figures 1, 2, 2A, 2B:
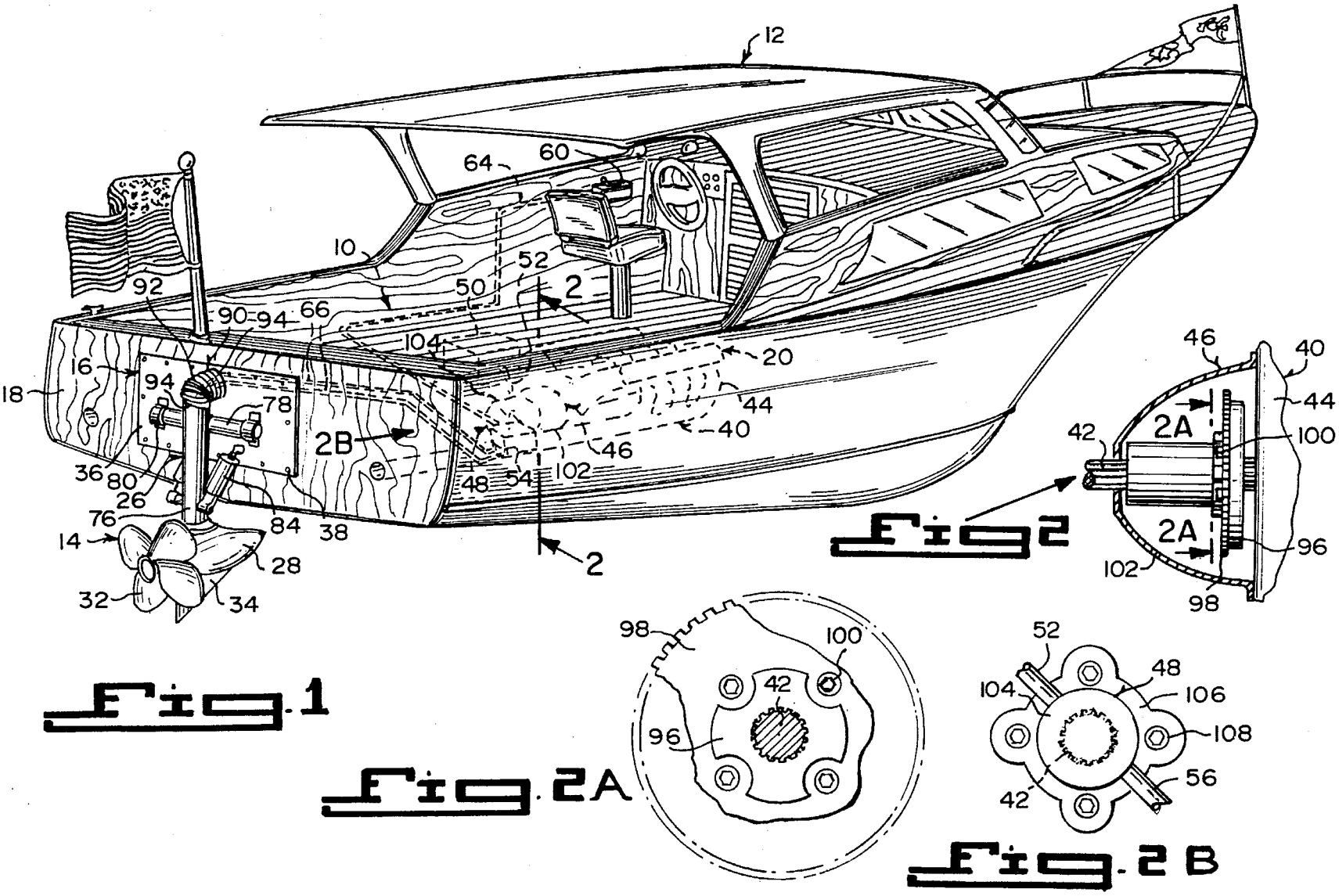
FIG. 1 is a rear perspective view of a boat with the instant invention installed therein.
FIG. 2 is a diagrammatic cross sectional view taken generally along line 2—2 in FIG. 1, showing the flywheel unit in greater detail.
FIG. 2A is a diagrammatic cross sectional view taken generally along line 2A—2A in FIG. 2, with parts broken away.
FIG. 2B is a diagrammatic end view of the hydraulic pump taken generally in the direction of arrow 2B in FIG. 1.
Figure 3:
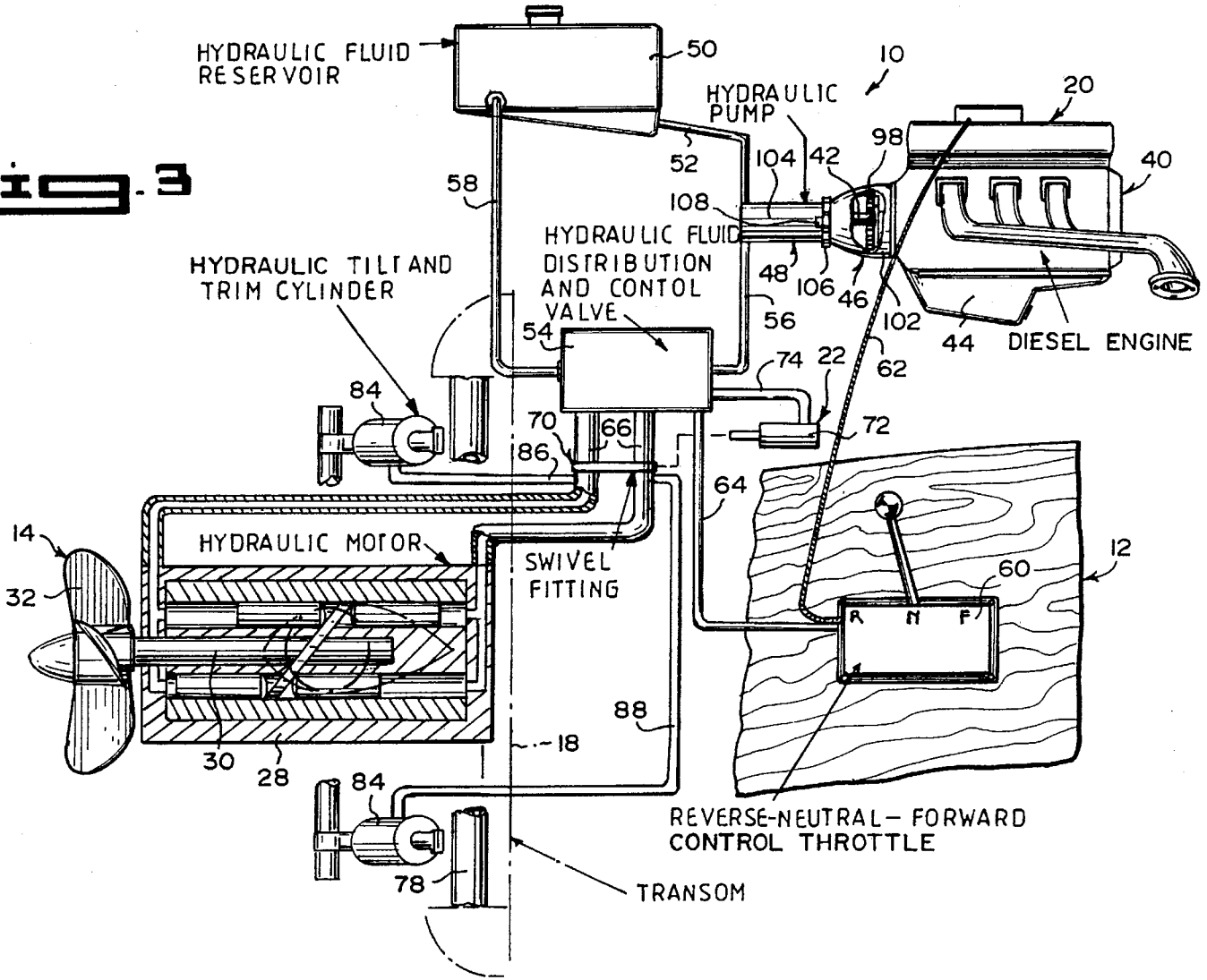
FIG. 3 is a diagrammatic view partly in section, showing the various components of the instant invention connected together in their relative positions.
Figure 4:
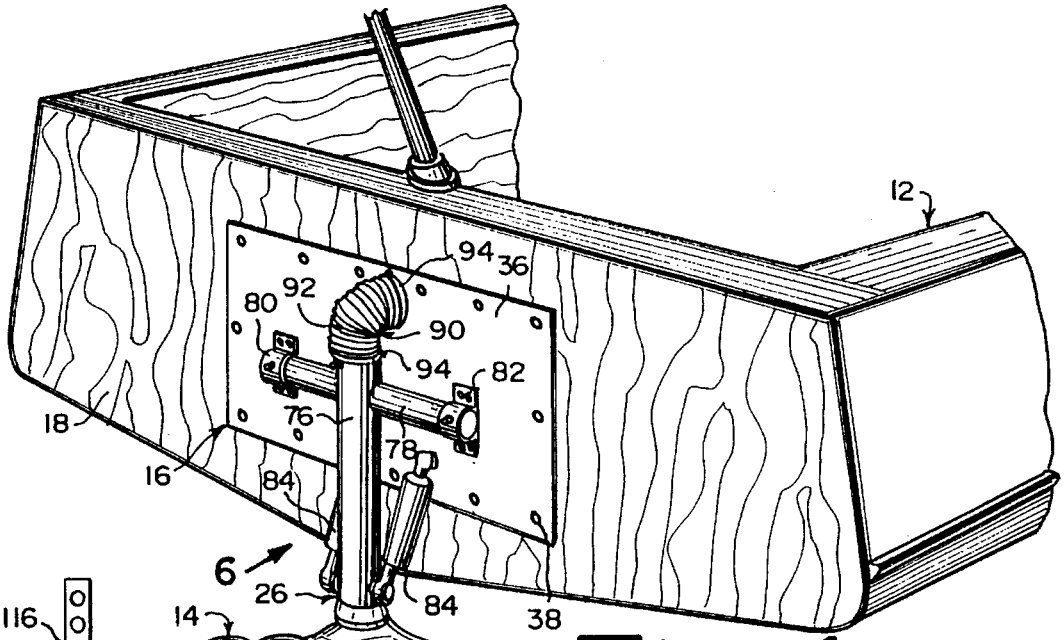
FIG. 4 is an enlarged rear perspective view of a portion of the boat showing the marine thruster assembly connected to the transom in greater detail.

Turning now descriptively to the drawings, in which similar reference characters denote similar elements throughout the several views, FIGS. 1 through 7 illustrate an hydraulic power system 10 for a boat 12 comprising a marine thruster assembly 14. A structure 16 is for mounting the marine thruster assembly 14 to an exterior surface of a transom 18 on the boat 12. A first hydraulic operative facility 20 is for propelling the marine thruster assembly 14, so that the boat 12 can travel in a body of water. A second hydraulic operative facility 22 is for steering the marine thruster assembly 14, so that the boat 12 can be directed on a course in the body of water. A third hydraulic operative facility 24 is for lifting the marine thruster assembly 14 out of the body of water for inspection and repair when needed.

The marine thruster assembly 14 includes a generally upright stanchion unit 26. An hydraulic motor 28 is at a lower end of the stanchion unit 26. An output shaft 30 is on the hydraulic motor 28. A propeller 32 is affixed to the output shaft 30. A skeg 34 extends downwardly from the hydraulic motor 28.

The mounting structure 16 consists of a plate 36 for supporting the stanchion unit 26. A plurality of fasteners 38 are for securing the plate 36 to the exterior surface of the transom 18 on the boat 12.

The first hydraulic operative facility 20 comprises an engine 40, having a drive shaft 42 extending from a housing 44. A flywheel unit 46 is connected to the housing 44 and is coupled to the drive shaft 42 of the engine 40. An hydraulic pump 48 is connected to the flywheel unit 46 and is coupled to the drive shaft 42 extending through the flywheel unit 46. An hydraulic fluid reservoir 50 is fluidly connected via an hydraulic line 52 to the hydraulic pump 48. An hydraulic fluid distribution and control valve 54 is fluidly connected via hydraulic lines 56, 58 between the hydraulic pump 48 and the hydraulic fluid reservoir 50. A reverse-neutral-forward control throttle 60 is electrically connected via cables 62, 64 between the engine 40 and the hydraulic fluid distribution and control valve 54. A pair of hydraulic hoses 66 are fluidly connected between the hydraulic fluid distribution and control valve 54 and the hydraulic motor 28 in the marine thruster assembly 14. The hydraulic hoses 66 extend through an aperture in the transom 18 on the boat 12, an aperture in the plate 36 and down through the stanchion unit 26.

The second hydraulic operative facility 22 includes the stanchion unit 26 having a hollow inner steering column 68 connected at a lower end to the hydraulic motor 28. The inner steering column 68 will carry the hydraulic hoses 66 to the hydraulic motor 28. A swivel fitting 70 is connected to an upper end of the inner steering column 68. An hydraulic cylinder 72 is fluidly connected via an hydraulic line 74 to the hydraulic fluid distribution and control valve 54. The hydraulic cylinder 72 is mechanically connected to the swivel fitting 70 through the aperture in the transom 18 on the boat 12 and the aperture in the plate 36, so as to move the swivel fitting 70 to turn the inner steering column 68 left and right.

The third hydraulic operative facility 24 consists of the stanchion unit 26 having a hollow outer tilting column 76 over the inner steering column 68. A pivot shaft 78 divided into two segments are transversely affixed to opposite sides of the outer tilting column 76 near an upper end thereof. A pair of connector caps 80 are provided. A plurality of fasteners 82 are for attaching the connector caps 80 to the plate 36, to allow the ends of the pivot shaft 78 to rotate thereabout. A pair of hydraulic tilt and trim cylinders 84 are mechanically connected between a lower end of the outer tilting column 76 and the plate 36 and are fluidly connected via hydraulic lines 86, 88 to the hydraulic fluid distribution and control valve 54. The hydraulic tilt and trim cylinders 84 can lift the outer tilting column 76 with the inner steering column 68 up and down.

Paraphernalia 90 at the upper end of the outer tilting column 76 is for covering in a waterproof manner the hydraulic hoses 66 and the swivel fitting 70, The covering paraphernalia 90 includes a flexible bellow-like rubber boot 92. A pair of clamps 94 are to secure the boot 92 to the upper end of the outer tilting column 76 and at the aperture in the plate 36.

The flywheel unit 46, as best seen in FIGS. 2 and 2A, contains a coupler disc member 96 internally splined onto a splined portion of the drive shaft 42 of the engine 40. A flywheel 98, fits onto the coupler disc member 96. A plurality of fasteners 100 are for securing the flywheel 98 to the coupler disc member 96. A bell 102 is a casing for covering the coupler disc member 96 and the flywheel 98. The bell casing 102 is affixed to the housing 44 of the engine 40.

The hydraulic pump 48, as best seen in FIG. 2B, includes an outer cover 104 with a mounting flange 106. A plurality of fasteners 108 are for securing the mounting flange 106 of the outer cover 104 to the bell casing 102.

Figure 5:
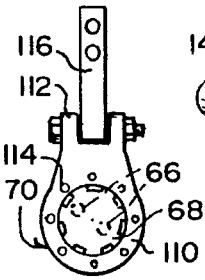
FIG. 5 is a diagrammatic top plan view of the swivel fitting.
Figure 6:
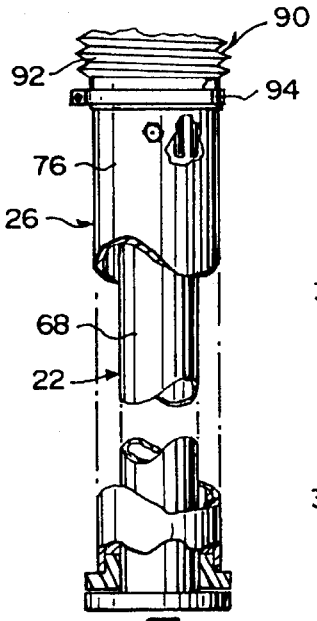
FIG. 6 is a rear elevational view taken in the direction of arrow 6 in FIG. 4 with parts broken away, showing the inner steering column and the outer tilting column of the marine thruster assembly in greater detail.
Figure 7:
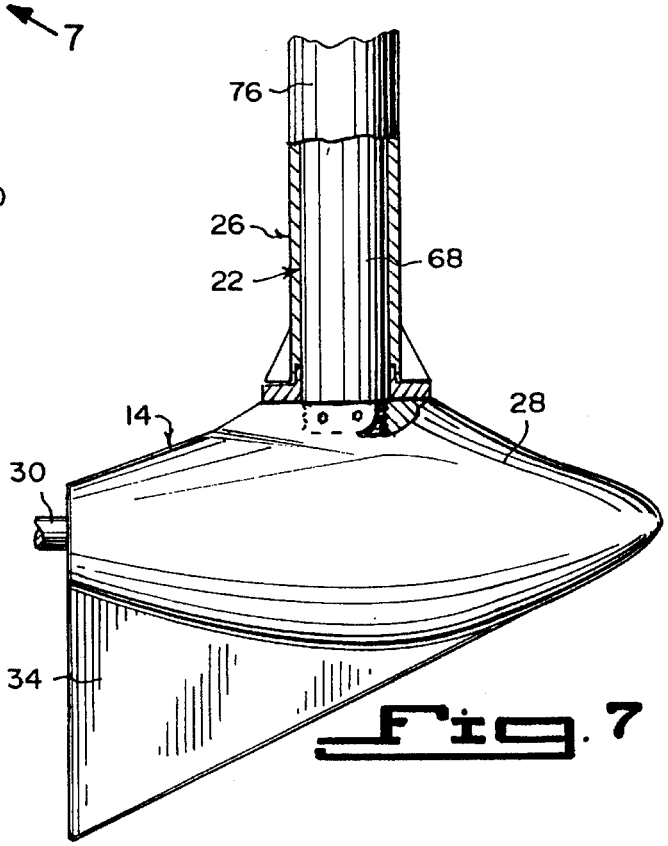
FIG. 7 is a side elevational view taken in the direction of arrow 7 in FIG. 4 with parts broken away, showing the hydraulic motor connected to the inner steering column of the marine thruster assembly.

The swivel fitting 70, as shown in FIG. 5, contains a collar member 110 internally splined onto a splined portion of the upper end of the inner steering column 68. The collar member 110 has a forked segment 112 extending rearwardly. A plurality of fasteners 114 are radially positioned about and through the collar member 110, to permanently secure the collar member 110 to the upper end of the inner steering column 68. A link arm 116 is mechanically connected between the forked segment 112 of the collar member 110 and the hydraulic cylinder 72.

LIST OF REFERENCE NUMBERS

| | |
|---|---|
| 10 | hydraulic power system |
| 12 | boat |
| 14 | marine thruster assembly |
| 16 | mounting structure |
| 18 | transom on 12 |
| 20 | first hydraulic operative facility |
| 22 | second hydraulic operative facility |
| 24 | third hydraulic operative facility |
| 26 | stanchion unit of 14 |
| 28 | hydraulic motor of 14 |
| 30 | output shaft on 28 |
| 32 | propeller on 30 |
| 34 | skeg on 28 |
| 36 | plate of 16 |
| 38 | fasteners of 16 |
| 40 | engine |
| 42 | drive shaft of 40 |
| 44 | housing of 40 |
| 46 | flywheel unit on 44 |
| 48 | hydraulic pump on 46 |
| 50 | hydraulic fluid reservoir |
| 52 | hydraulic line between 48 and 50 |
| 54 | hydraulic fluid distribution and control valve |
| 56 | hydraulic line between 48 and 54 |
| 58 | hydraulic line between 50 and 54 |
| 60 | reverse-neutral-forward control throttle |
| 62 | cable between 40 and 60 |
| 64 | cable between 54 and 60 |
| 66 | hydraulic hose between 28 and 54 |
| 68 | inner steering column of 26 |
| 70 | swivel fitting on 68 |
| 72 | hydraulic cylinder |
| 74 | hydraulic line between 54 and 72 |
| 76 | outer tilting column of 26 |
| 78 | pivot shaft |
| 80 | connector cap |
| 82 | fastener of 80 |
| 84 | hydraulic tilt and trim cylinder |
| 86 | hydraulic line between 54 and 84 |
| 88 | hydraulic line between 54 and 84 |
| 90 | covering paraphernalia |
| 92 | flexible bellows-like rubber boot |
| 94 | clamp for 92 |
| 96 | coupler disc member on 42 |
| 98 | flywheel on 96 |

-continued

| | |
|---|---|
| 100 | fastener for 96 and 98 |
| 102 | bell casing |
| 104 | outer cover of 48 |
| 106 | mounting flange on 104 |
| 108 | fastener for 102 and 106 |
| 110 | collar member of 70 |
| 112 | forked segment of 110 |
| 114 | fasteners for 68 and 110 |
| 116 | link arm between 72 and 112 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An hydraulic power system for a boat comprising:

a) a marine thruster assembly, said marine thruster assembly including a generally upright stanchion unit, an hydraulic motor at a lower end of said stanchion unit, an output shaft on said hydraulic motor, a propeller affixed to said output shaft, and a skeg extending downwardly from said hydraulic motor;

b) means for mounting said marine thruster assembly to an exterior surface of a transom on the boat, said mounting means including a plate for supporting said stanchion unit, and a plurality of fasteners for securing said plate to the exterior surface of the transom on the boat;

c) a first hydraulic operative means for propelling said marine thruster assembly, so that the boat can travel in a body of water, said first hydraulic operative means including an engine having a drive shaft extending from a housing; a flywheel unit connected to said housing and coupled to said drive shaft of said engine, an hydraulic pump connected to said flywheel unit and coupled to said drive shaft extending through said flywheel unit, an hydraulic fluid reservoir fluidly connected via an hydraulic line to said hydraulic pump, an hydraulic fluid distribution and control valve fluidly connected via hydraulic lines between said hydraulic pump and said hydraulic fluid reservoir, a reverse-neutral-forward control throttle electrically connected via cables between said engine and said hydraulic fluid distribution and control valve, and a pair of hydraulic hoses fluidly connected between said hydraulic fluid distribution and control valve and said hydraulic motor in said marine thruster assembly, whereby said hydraulic hoses extend through an aperture in the transom on the boat, an aperture in said plate and down through said stanchion unit;

d) a second hydraulic operative means for steering said marine thruster assembly, so that the boat can be directed on a course in the body of water, said second hydraulic operative means including said stanchion unit having a hollow inner steering column connected at a lower end to said hydraulic motor, whereby said inner steering column will carry said hydraulic hoses to said hydraulic motor, a swivel fitting connected to an upper end of said inner steering column, and an hydraulic cylinder fluidly connected via an hydraulic line to said hydraulic fluid distribution and control valve, whereby said hydraulic cylinder is mechanically connected to said swivel fitting through the aperture in the transom on the boat and the aperture in said plate, so as to move said swivel fitting to turn said inner steering column left and right; and e) a third hydraulic operative means for lifting said marine thruster assembly out of the body of water for inspection and repair when needed.

2. An hydraulic power system for a boat as recited in claim 1, wherein said third hydraulic operative means includes:

a) said stanchion unit having a hollow outer tilting column over said inner steering column;

b) a pivot shaft divided into two segments that are transversely affixed to opposite sides of said outer tilting column near an upper end thereof;

c) a pair of connector caps;

d) a plurality of fasteners for attaching said connector caps to said plate to allow the ends of said pivot shaft to rotate thereabout; and e) a pair of hydraulic tilt and trim cylinders mechanically connected between a lower end of said outer tilting column and said plate and are fluidly connected via hydraulic lines to said hydraulic fluid distribution and control valve, whereby said hydraulic tilt and trim cylinders can lift said outer tilting column with said inner steering column up and down.

3. An hydraulic power system for a boat as recited in claim 2, further including means at the upper end of said outer tilting column for covering in a waterproof manner said hydraulic hoses and said swivel fitting.

4. An hydraulic power system for a boat as recited in claim 3, wherein said covering means includes:

a) a flexible bellows shaped rubber boot; and b) a pair of clamps to secure said boot to the upper end of said outer tilting column and at the aperture in said plate.

5. An hydraulic power system for a boat as recited in claim 4, wherein said flywheel unit includes:

a) a coupler disc member internally splined onto a splined portion of said drive shaft of said engine;

b) a flywheel which fits onto said coupler disc member;

c) a plurality of fasteners for securing said flywheel to said coupler disc member; and d) a bell casing for covering said coupler disc member and said flywheel, whereby said bell casing is affixed to said housing of said engine.

6. An hydraulic power system for a boat as recited in claim 5, wherein said hydraulic pump includes:

a) an outer cover with a mounting flange; and b) a plurality of fasteners for securing said mounting flange of said outer cover to said bell casing.

7. An hydraulic power system as recited in claim 6, wherein said swivel fitting includes:

a) a collar member internally splined onto a splined portion of the upper end of said inner steering column, said collar member having a forked segment extending rearwardly;

b) a plurality of fasteners radially positioned about and through said collar member to permanently secure said collar member to the upper end of said inner steering column; and c) a link arm mechanically connected between the forked segment of said collar member and said hydraulic cylinder.

* * * * *